US005620319A

United States Patent [19]

Lungershausen

[11] Patent Number: 5,620,319

[45] Date of Patent: Apr. 15, 1997

[54] PHOTOFLASH LAMP WITH OPTICAL ELEMENT UNDERGOING HEAT GENERATED CHANGE FROM SUBSTANTIALLY UNIFORM THICKNESS TO BEING THICKER IN THE CENTER, DURING FLASH IGNITION, TO ENHANCE LIGHT OUTPUT BY CONVERGING LIGHT RAYS

[75] Inventor: Arnold W. Lungershausen, West Henrietta, N.Y.

[73] Assignee: Eastman Kodak Company, Rochester, N.Y.

[21] Appl. No.: 627,860

[22] Filed: Apr. 3, 1996

[51] Int. Cl.[6] ..... F21K 5/00

[52] U.S. Cl. ..... 431/360; 362/6; 362/16; 431/357

[58] Field of Search ..... 431/357–365; 362/11, 16, 17, 6, 255, 256

[56] References Cited

U.S. PATENT DOCUMENTS

| | | | |
|---|---|---|---|
| 2,272,059 | 2/1942 | De Margitta | 67/31 |
| 2,289,876 | 7/1942 | De Margitta | 431/362 |
| 3,215,883 | 11/1965 | McClees | 431/360 |
| 3,832,125 | 8/1974 | McDonough et al. | 431/360 |
| 3,992,136 | 11/1976 | Shaffer | 431/94 |
| 4,234,906 | 11/1980 | Schindler | 362/16 |
| 4,462,063 | 7/1984 | English | 362/11 |
| 4,498,883 | 2/1985 | Bouchard et al. | 445/28 |

*Primary Examiner*—James C. Yeung
*Attorney, Agent, or Firm*—Roger A. Fields

[57] ABSTRACT

A photoflash lamp comprising a lamp housing, a combustible material burning inside the lamp housing to produce a flash illumination, and ignition means for igniting the combustible material, is characterized by optical element means on the lamp housing for changing from a substantially uniform thickness to being thicker in a center than at an edge, responsive to the lamp housing becoming heated when the combustible material is burned inside the lamp housing to produce the flash illumination. The optical element, when changed from a substantially uniform thickness to being thicker in the center than at the edge, forms a positive lens that converges the light rays during flash illumination to enhance the light output.

6 Claims, 3 Drawing Sheets

PHOTOFLASH LAMP WITH OPTICAL ELEMENT UNDERGOING HEAT GENERATED CHANGE FROM SUBSTANTIALLY UNIFORM THICKNESS TO BEING THICKER IN THE CENTER, DURING FLASH IGNITION, TO ENHANCE LIGHT OUTPUT BY CONVERGING LIGHT RAYS

FIELD OF THE INVENTION

The invention relates generally to the field of photography, and in particular to photoflash lamps.

More specifically, the invention relates to a combustible photoflash lamp having an optical element that undergoes a change from a substantially uniform thickness to being thicker in the center than at the edge responsive to the heat generated during flash combustion. The change in the shape of the optical element converges the light rays during flash illumination to enhance the light output.

BACKGROUND OF THE INVENTION

It is well known for a photoflash lamp to comprise a hermetically sealed lamp housing with a combustion-supporting gas fill, a filamentary combustible material which is rapidly burned inside the lamp housing to produce a flash illumination, and a primer connected to a pair of lead-in wires (or other ignition means) for igniting the combustible material. See for example U.S. Pat. No. 3,992,136, issued Nov. 16, 1976.

Going one step further, U.S. Pat. Nos. 4,462,063, issued Jul. 24, 1984, and No. 2,272,059, issued Feb. 3, 1942, suggest including a pre-formed aspheric or other type lens on the lamp housing to enhance the light output during flash illumination.

SUMMARY OF THE INVENTION

Broadly speaking, the invention is a photoflash lamp comprising a lamp housing, a combustible material burning inside the lamp housing to produce a flash illumination, and ignition means for igniting the combustible material, characterized by:

optical element means on the lamp housing for changing shape responsive to the lamp housing becoming heated when the combustible material is burned inside the lamp housing to produce the flash illumination, for enhancing the light output of the flash illumination.

More particularly, the invention is a photoflash lamp comprising a lamp housing, a combustible material burning inside the lamp housing to produce a flash illumination, and ignition means for igniting the combustible material, characterized by:

optical element means on the lamp housing for changing from a substantially uniform thickness to being thicker in a center than at an edge, responsive to the lamp housing becoming heated when the combustible material is burned inside the lamp housing to produce the flash illumination. The optical element, when changed from a substantially uniform thickness to being thicker in the center than at the edge, forms a positive lens that converges the light rays during flash illumination to enhance the light output.

DETAILED DESCRIPTION OF THE INVENTION

The invention is disclosed as being embodied preferably in a photoflash lamp. Because the features of a photoflash lamp are generally known, the description which follows is directed in particular only to those elements forming part of or cooperating directly with the disclosed embodiment. It is to be understood, however, that other elements may take various forms known to a person of ordinary skill in the art.

Figure 1:
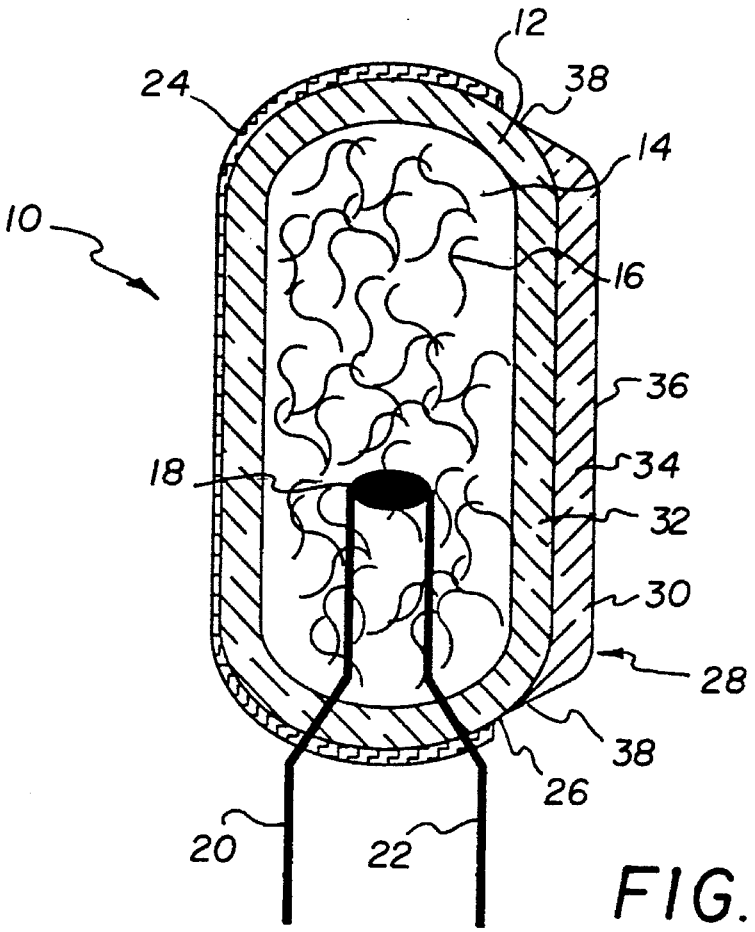
FIG. 1 is an elevation cross-section view of a photoflash lamp according to a preferred embodiment of the invention, showing an optical element on the lamp housing.
Figure 2:
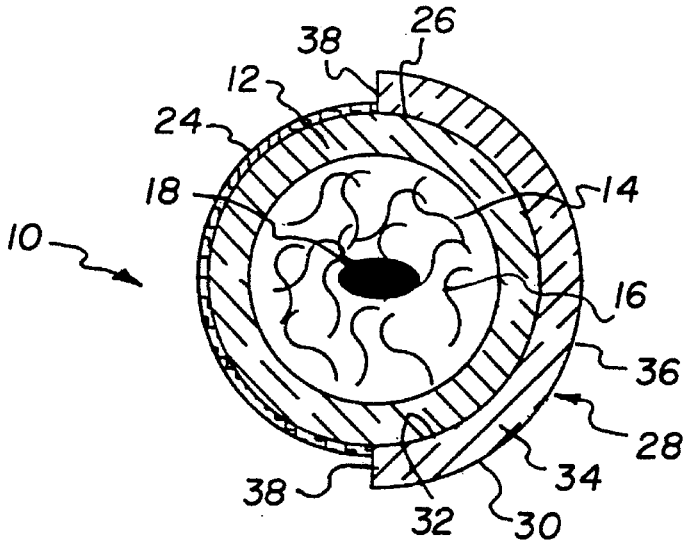
FIG. 2 is a top plan cross-section view of the photoflash lamp as shown in FIG. 1.

Referring now to the drawings, FIGS. 1 and 2 show an electrically ignitable photoflash lamp 10 comprising a hermetically sealed transparent glass lamp housing 12, a combustion-supporting gas fill 14 such as oxygen in the lamp housing, a filamentary combustible material 16 such as shredded zirconium or hafnium foil which is rapidly burned inside the lamp housing to produce a flash illumination, a primer bead 18 connected to a pair of lead-in wires 20 and 22 (or other known ignition means) for igniting the combustible material, and an aluminum reflective coating 24 on the exterior (or interior) surface 26 of the lamp housing. Typically, the combustion-supporting gas fill 14 is at a pressure exceeding one atmosphere.

A transparent plastic optical element 28 has a forward outer surface 30 and an opposite, rearward inner surface 32. The optical element 28 is affixed to (or integrally formed with) the lamp housing 12. The rearward inner surface 32 of the optical element 28 is totally in contact with the exterior surface 26 of the lamp housing. As shown in FIGS. 1 and 2, the optical element 28 is originally in the form of a window 34. A "window", as is known in the optics art, is an optical element having its opposite surfaces parallel to one another.

Figure 3:
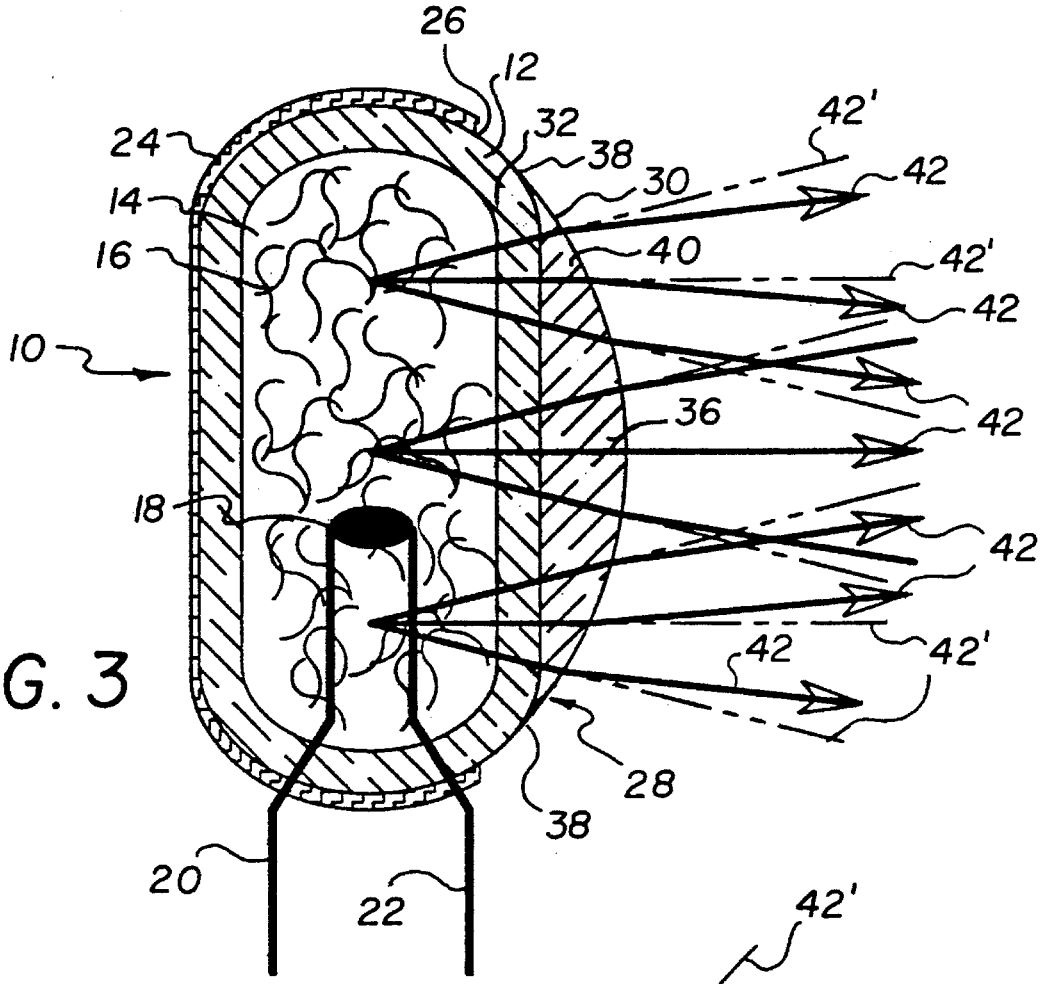
FIG. 3 is an elevation cross-section view of the photoflash lamp, showing the optical element changed in shape to converge the light rays during flash illumination to enhance the light output.
Figure 4:
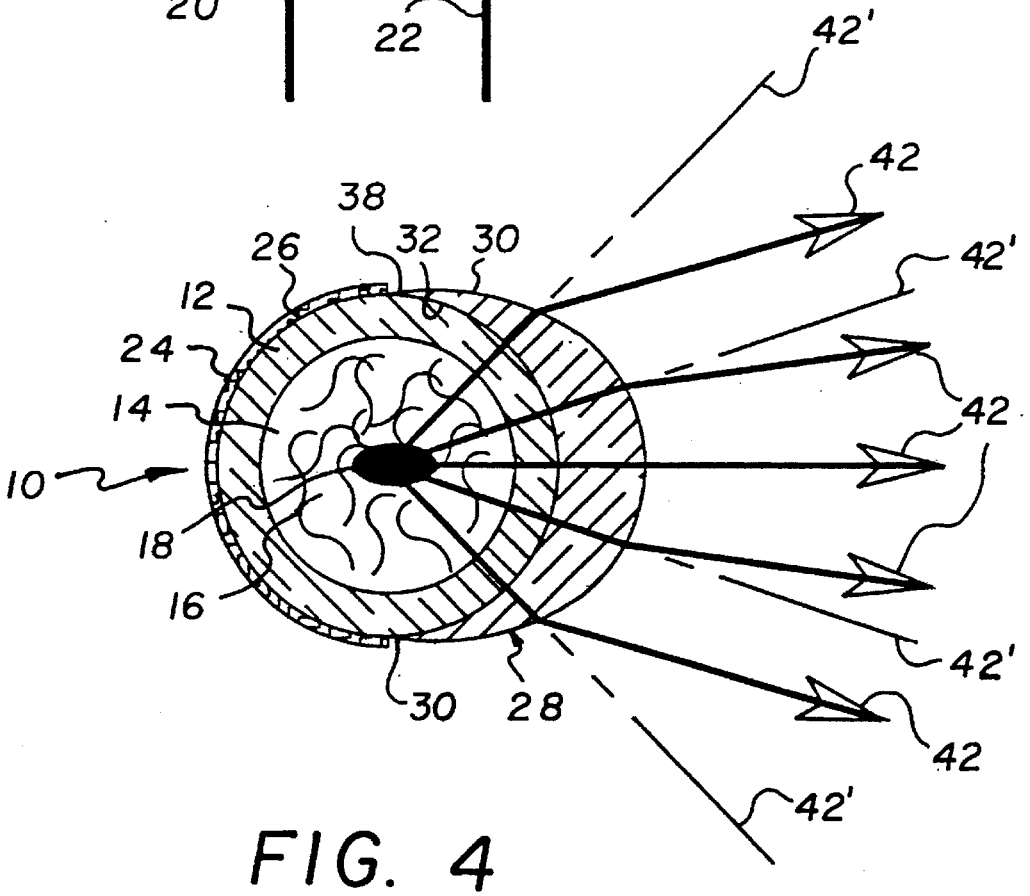
FIG. 4 is a top plan cross-section view of the photoflash lamp as shown in FIG. 3.

When the combustible material 16 is burned inside the lamp housing 12 to produce the flash illumination, the lamp housing becomes heated to change the optical element 28 from a substantially uniform thickness to being thicker in the center 36 than at the edge 38. See FIGS. 3 and 4. Consequently, the shape of the optical element 28 is changed to transform the optical element from the window 34 to a positive lens 40. The positive lens 40 converges the light rays 42 during flash illumination to enhance the light output. This can be seen by comparing the light rays 42 depicted in FIGS. 3 and 4 in solid lines with those 42' depicted in the same FIGS. in broken lines. The solid lines indicate the light rays 42, when converged, as they are transmitted through the positive lens 40 and the broken lines indicate the light rays 42', when not converged, as they would be transmitted through the window 34.

Figure 5:
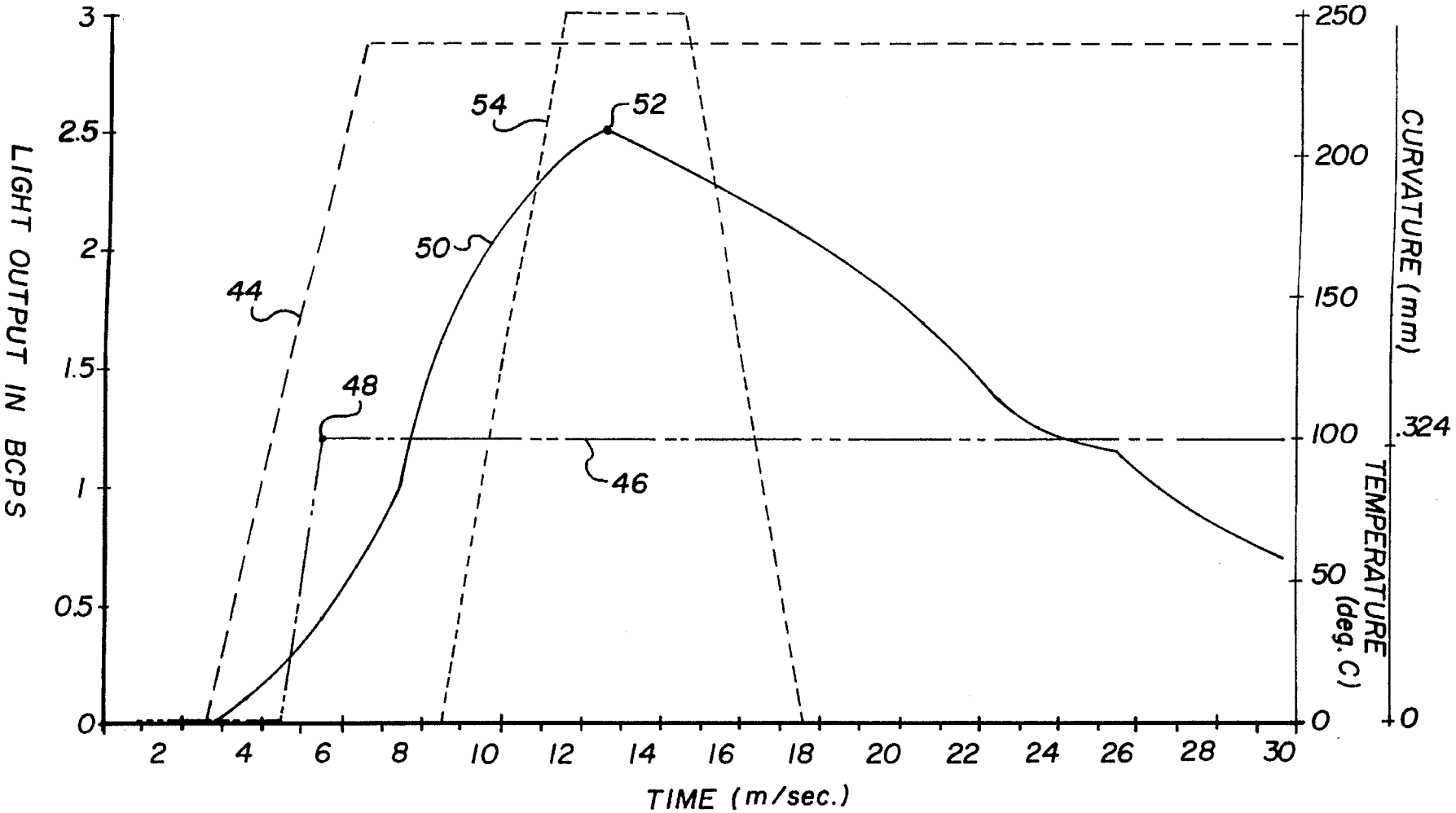
FIG. 5 is chart schematically depicting operation of the photoflash lamp in conjunction with a camera shutter.

Going now to FIG. 5, thre is provided a chart which schematically depicts operation of the photoflash lamp 10 in conjunction with a camera shutter. In FIG. 5, the multi-dash line 44 indicates the temperature increase at the interface between the lamp housing 12 and the optical element 28 when the combustible material 16 is burned inside the lamp housing to produce the flash illumination. The dash-dot line 46 indicates the resulting transformation in curvature of the optical element 28 from the window 34 to the positive lens 40. As shown, the transformation is 100% completed at the point 48 on the dash-dot line 46. The solid line 50 indicates the light output of the flash illumination. As shown, the light output peaks in intensity at the point 52 on the solid line 50. The dot line 54 indicates shutter opening and closing. Thus, the chart indicates that the optical element 28 is transformed from the window 34 to the positive lens 40 before the camera shutter begins to open, and the camera shutter is fully opened when the flash illumination peaks.

The invention has been described with reference to a preferred embodiment. However, it will be appreciated that variations and modifications can be effected by a person of ordinary skill in the art without departing from the scope of the invention.

PARTS LIST

10. photoflash lamp
12. glass lamp housing
14. combustion-supporting gas fill
16. filamentary combustible material
18. primer bead
20. lead-in wire
22. lead-in wire
24. aluminum reflective coating
26. exterior surface of lamp housing
28. plastic optical element
30. forward outer surface of optical element
32. rearward inner surface of optical element
34. window
36. center of optical element
38. edge of optical element
40. positive lens
42, 42'. light rays
44. multi-dash line
46. dash-dot line
48. point on dash-dot line
50. solid line
52. point on solid line
54. dot line

I claim:

1. A photoflash lamp comprising a lamp housing, a combustible material burning inside said lamp housing to produce a flash illumination, and ignition means for igniting said combustible material, is characterized by:

optical element means on said lamp housing for changing shape responsive to the lamp housing becoming heated when said combustible material is burned inside the lamp housing to produce the flash illumination, for enhancing the light output of the flash illumination.

2. A photoflash lamp comprising a lamp housing, a combustible material burning inside said lamp housing to produce a flash illumination, and ignition means for igniting said combustible material, is characterized by:

optical element means on said lamp housing for changing from a substantially uniform thickness to being thicker in a center than at an edge, responsive to the lamp housing becoming heated when said combustible material is burned inside the lamp housing to produce the flash illumination.

3. A photoflash lamp as recited in claim 2, wherein said optical element means has a pair of opposite surfaces that change from being parallel to being non-parallel when the optical element means changes from a substantially uniform thickness to being thicker in the center than at the edge.

4. A photoflash lamp as recited in claim 3, wherein said optical element means defines a window when said opposite surfaces are parallel and defines a positive lens when the opposite surfaces are non-parallel.

5. A photoflash lamp as recited in claim 4, wherein said one of said opposite surfaces is a rearward inner surface totally in contact with said lamp housing and the other opposite surface is a forward outer surface not in contact with the lamp housing.

6. A method of enhancing light output for a photoflash lamp comprising a lamp housing, a combustible material burning inside the lamp housing to produce a flash illumination, and ignition means for igniting the combustible material, is characterized by:

changing optical element means on the lamp housing from a substantially uniform thickness to being thicker in a center than at an edge, responsive to the lamp housing becoming heated when the combustible material is burned inside the lamp housing to produce the flash illumination.

* * * * *